US010870515B2

(12) United States Patent
Pearce

(10) Patent No.: US 10,870,515 B2
(45) Date of Patent: Dec. 22, 2020

(54) CONTAINER SLEEVE SYSTEM

(71) Applicant: Joseph Pearce, Newport Coast, CA (US)

(72) Inventor: Joseph Pearce, Newport Coast, CA (US)

( * ) Notice: Subject to any disclaimer, the term of this patent is extended or adjusted under 35 U.S.C. 154(b) by 0 days.

(21) Appl. No.: 16/842,507

(22) Filed: Apr. 7, 2020

(65) Prior Publication Data

US 2020/0339305 A1 Oct. 29, 2020

Related U.S. Application Data

(60) Provisional application No. 62/839,593, filed on Apr. 26, 2019.

(51) Int. Cl.

| | |
|---|---|
| ***B65D 23/10*** | (2006.01) |
| ***B65D 23/08*** | (2006.01) |
| ***B65D 51/24*** | (2006.01) |
| ***A45F 3/18*** | (2006.01) |

(52) U.S. Cl.

CPC ..... *B65D 23/106* (2013.01); *A45F 3/18* (2013.01); *B65D 23/0842* (2013.01); *B65D 51/242* (2013.01)

(58) Field of Classification Search

CPC .. B65D 23/106; B65D 23/0842; B65D 23/10; B65D 23/104; B65D 25/20; B65D 51/242; A47G 23/0241; A47G 23/0266; A47G 23/0216; A61J 9/08; A61J 9/06; A61J 9/0623; A45F 3/18; A45F 5/10; A45F 2005/1006; A45F 2005/1013

USPC .... 294/31.2, 157, 33, 32, 27.1, 29; 215/396, 215/395, 376, 393; 220/741–742, 737, 220/754–755, 758–759; D7/622, 624.2; 16/425, 422, 145.6

See application file for complete search history.

(56) References Cited

U.S. PATENT DOCUMENTS

| | | | | | |
|---|---|---|---|---|---|
| 1,242,994 | A * | 10/1917 | Skiff | B65D 23/106 | 222/472 |
| 1,428,758 | A * | 9/1922 | Cowles | A61J 9/06 | 215/11.6 |
| 2,706,571 | A * | 4/1955 | Ryan | A61J 9/08 | 215/12.1 |
| 2,838,202 | A * | 6/1958 | Huether | A47G 23/0266 | 220/741 |
| 2,981,562 | A * | 4/1961 | Long | A47G 23/0241 | 294/31.2 |
| 3,116,947 | A * | 1/1964 | Brownrigg | A45F 5/10 | 294/31.2 |
| 3,458,164 | A * | 7/1969 | Massey | A47G 23/0266 | 248/145.6 |
| 3,682,352 | A * | 8/1972 | Doucette | B65D 25/2817 | 220/754 |

(Continued)

*Primary Examiner* — Chun Hoi Cheung
*Assistant Examiner* — Brijesh V. Patel
(74) *Attorney, Agent, or Firm* — John D. Tran; Rhema Law Group

(57) ABSTRACT

A container sleeve system and method of manufacture thereof can include: a container having a shoulder; and a sleeve having coupling ends coupled together with a handle therebetween, the coupling ends including a rounded overhang, the coupling ends including bottom retention recesses formed within a bottom side thereof, and the shoulder extending through the rounded overhang, and the handle including a handle body providing thickness to the handle, the handle body formed on the handle.

20 Claims, 15 Drawing Sheets

(56) References Cited

U.S. PATENT DOCUMENTS 3,799,600 A * 3/1974 Chappell ..... A47G 23/0241 294/31.2
3,979,011 A * 9/1976 Schleicher ..... A47G 23/0266 220/742
4,511,167 A * 4/1985 Kawaguchi ..... A47J 45/077 294/28
4,666,197 A * 5/1987 Watson ..... B65D 23/106 215/396
5,011,536 A * 4/1991 Boom ..... A45F 5/10 134/42
5,013,074 A * 5/1991 Galle ..... A47G 23/0241 215/395
D321,654 S * 11/1991 White ..... D7/622
D332,379 S * 1/1993 Murphy ..... D7/391
5,176,280 A * 1/1993 Robbins, III ..... A45F 5/10 294/31.2
5,335,954 A * 8/1994 Holub ..... A45F 5/10 294/31.2
5,413,231 A * 5/1995 Carroll ..... B65D 23/106 215/396
5,655,805 A * 8/1997 Shaddy ..... A47G 23/0216 220/738
6,003,205 A * 12/1999 Dehaven ..... B65D 23/106 16/422
6,651,838 B2 * 11/2003 Bissell ..... B65D 23/106 215/395
7,118,005 B2 * 10/2006 Shimazaki ..... F25D 3/08 220/737
D557,567 S * 12/2007 Gronikowski ..... D7/622
D575,580 S * 8/2008 Germany ..... D7/392.1
D587,569 S * 3/2009 Eveleth ..... F25D 3/08 D9/434
7,527,310 B2 * 5/2009 Shaskey, Sr. ..... B65D 23/106 215/396
D618,065 S * 6/2010 Joy ..... B65D 23/106 D7/607
D636,640 S * 4/2011 Latham ..... D7/622
D643,289 S * 8/2011 Harlan ..... D7/622
8,353,419 B2 * 1/2013 Jung ..... A47J 41/0011 220/254.3
D696,557 S * 12/2013 Schanhals ..... A45F 5/10 D7/624.2
D703,997 S * 5/2014 Munari ..... D7/393
D707,087 S * 6/2014 Joy ..... A61J 9/06 D7/607
8,899,644 B2 * 12/2014 Hancey ..... A45F 5/10 215/396
D781,113 S * 3/2017 Kocsis ..... B65D 51/242 D7/624.2
D786,012 S * 5/2017 Hein ..... B65D 23/106 D7/396.2
9,771,180 B2 * 9/2017 Iwashita ..... B65D 23/106
D812,988 S * 3/2018 Seiders ..... B65D 51/242 D7/622
D849,482 S * 5/2019 Diener ..... D7/510
D863,895 S 10/2019 Pearce
D877,560 S * 3/2020 Lane ..... A47J 41/0011 D7/392
2001/0040380 A1 * 11/2001 Forjone ..... B65D 23/106 294/31.2
2010/0224585 A1 * 9/2010 Feeley ..... B65D 25/20 215/11.1
2013/0020317 A1 * 1/2013 Martin ..... A61J 9/08 220/23.91
2014/0332440 A1 * 11/2014 Marcus ..... A47G 23/02 206/591
2015/0250684 A1 * 9/2015 Cross ..... A47G 23/0216 215/395
2015/0359366 A1 * 12/2015 Yan ..... A47G 23/0216 215/395
2016/0318693 A1 * 11/2016 Hein ..... B65D 81/3841
2017/0158412 A1 * 6/2017 Seiders ..... B65D 23/106
2019/0055060 A1 * 2/2019 Mouneimne ..... B65D 51/242

* cited by examiner

CONTAINER SLEEVE SYSTEM

CROSS-REFERENCE TO RELATED APPLICATIONS

This claims priority benefit to all common subject matter of U.S. Provisional Patent Application 62/839,593 filed Apr. 26, 2019. The content of this application is incorporated herein by reference, in its entirety.

TECHNICAL FIELD

This disclosure relates to container systems, more particularly to container systems implementing sleeves.

BACKGROUND

Reusable water bottles, especially stainless-steel insulated containers are increasing in popularity as the public tries to minimize plastic usage. Unlike disposable bottles, reusable bottles can represent an investment deserving protection.

This protection can include: bags, sleeves, built in bumpers, or stickers and tape. Bags can offer versatility with regard to the shape of the container protected. Bags can also be easy to clean, but provide only partial protection as the bag does not protect the container while being held or used by the user when removed from the bag.

Sleeves can provide a robust protection while simultaneously remaining easy to disassemble and clean. Sleeves can even provide versatility in shape when a highly elastic sleeves is employed. Built in protection, such as molded corner bumpers, can provide good protection but fail to provide versatility, in terms of changing shape and size, as the bottle must be manufactured with the bumper.

Tape and stickers have been used to provide protection; however these protections exhibit poor wear characteristics, are difficult to remove and clean, and can allow the container to wear unevenly. In light of these protective solutions, container sleeves provide many clear advantages; however, prior developments in container sleeves fall short of providing a durable, portable, and reusable sleeve for a variety of reusable drinking containers.

One previous development, for example the cozy provides a smooth neoprene sleeve for containers. This development can wrap a container keeping the container thermally insulated and providing a measure of physical protection. However, the cozy is typically mounted with a friction fit around vertical container sides.

This friction fit can slip if the container is pushed out the top of the cozy resulting in damage to the container. Further, the smooth surface makes gripping, handling, and transporting the cozy difficult.

As competition for container protection grows meaningful market differentiation becomes more crucial and more difficult. Providing solutions to container sleeve system durability, portability, and reusability, therefore, remains central to next generation container sleeve market development strategies.

Yet another consideration for next generation container sleeves are market pressures including manufacturing simplicity and costs. Previous solutions, such as the cozy, require multiple manufacturing steps including neoprene manufacturing, cutting, folding, and sewing. These multiple process steps increase manufacturing time, costs, and complexity.

Solutions have been long sought but prior developments have not taught or suggested any complete solutions, and solutions to these problems have long eluded those skilled in the art. Thus there remains a considerable need for container sleeve systems and methods that can provide a durable, portable, and reusable sleeve for a variety of reusable drinking containers with simple and cost effective manufacturing.

SUMMARY

A container sleeve system and methods, providing practical, significant, and improved solutions to container sleeve system with improved durability, portability, and reusability for a variety of reusable drinking containers, with simple and cost effective manufacturing, are disclosed. The container sleeve system and method of manufacture thereof can include: a container sleeve system and method of manufacture thereof can include: a container having a shoulder; and a sleeve having coupling ends coupled together with a handle therebetween, the coupling ends including a rounded overhang, the coupling ends including bottom retention recesses formed within a bottom side thereof, and the shoulder extending through the rounded overhang, and the handle including a handle body providing thickness to the handle, the handle body formed on the handle.

Other contemplated embodiments can include objects, features, aspects, and advantages in addition to or in place of those mentioned above. These objects, features, aspects, and advantages of the embodiments will become more apparent from the following detailed description, along with the accompanying drawings.

BRIEF DESCRIPTION OF THE DRAWINGS

The container sleeve system is illustrated in the figures of the accompanying drawings which are meant to be exemplary and not limiting, in which like reference numerals are intended to refer to like components, and in which.

DETAILED DESCRIPTION

Figure 1:
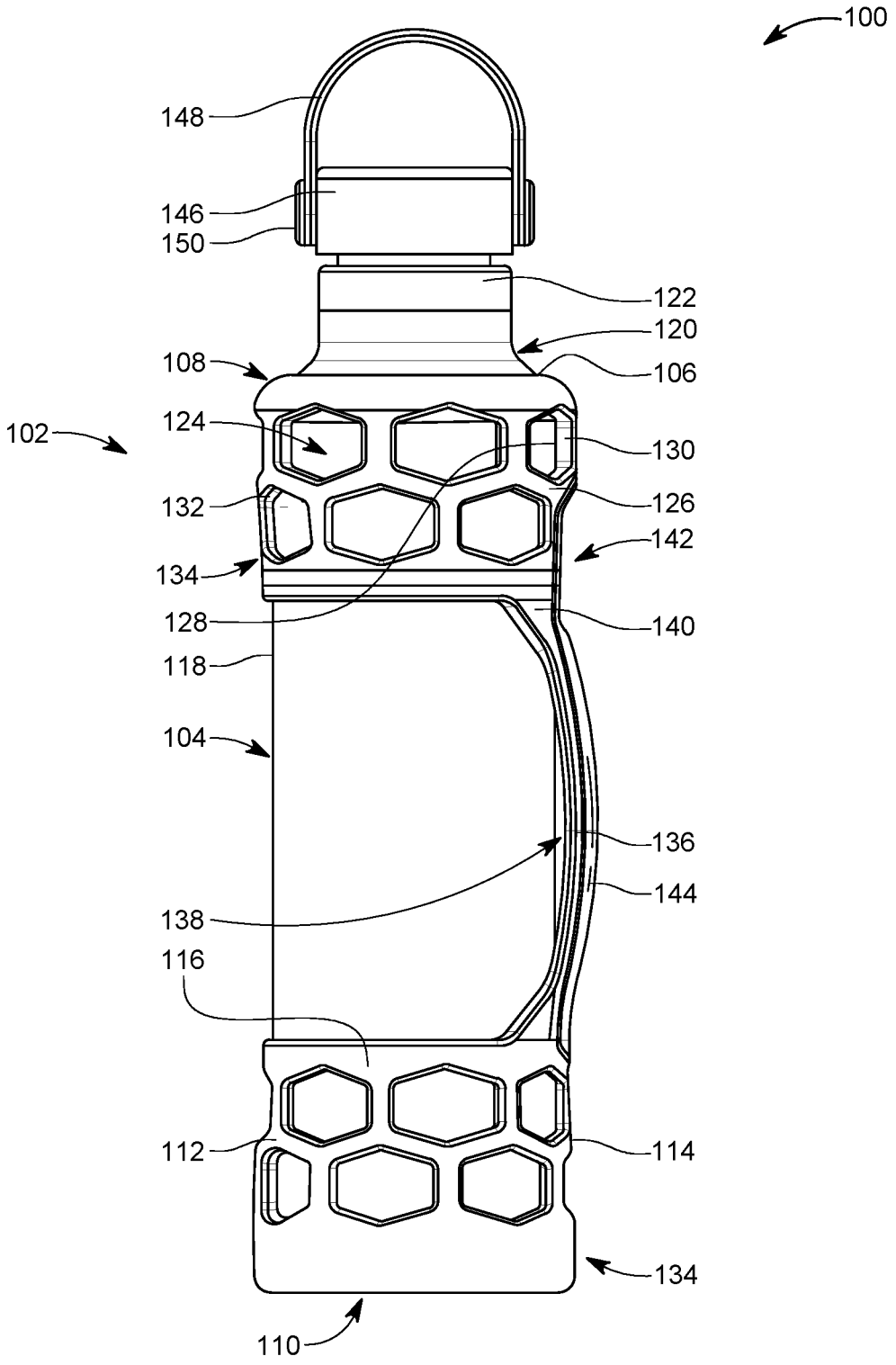
FIG. 1 is a left side view of the container sleeve system.

In the following description, reference is made to the accompanying drawings that form a part hereof, and in which are shown by way of illustration, embodiments in which the container sleeve system may be practiced. It is to be understood that other embodiments may be utilized and structural changes may be made without departing from the scope of the container sleeve system.

When features, aspects, or embodiments of the container sleeve system are described in terms of steps of a process, an operation, a control flow, or a flow chart, it is to be understood that the steps can be combined, performed in a different order, deleted, or include additional steps without departing from the container sleeve system as described herein.

The container sleeve system is described in sufficient detail to enable those skilled in the art to make and use the container sleeve system and provide numerous specific details to give a thorough understanding of the container sleeve system; however, it will be apparent that the container sleeve system may be practiced without these specific details.

In order to avoid obscuring the container sleeve system, some well-known system configurations and descriptions are not disclosed in detail. Likewise, the drawings showing embodiments of the system are semi-diagrammatic and not to scale and, particularly, some of the dimensions are for the clarity of presentation and are shown greatly exaggerated in the drawing FIGs.

As used herein, the term system is defined as a device or method depending on the context in which it is used. For expository purposes, the term "horizontal" as used herein is defined as a plane parallel to the top plane or surface of the top lip of the sleeve, regardless of its orientation. The term "vertical" refers to a direction perpendicular to the horizontal as just defined. Terms, such as "above", "below", "bottom", "top", "side", "higher", "lower", "upper", "over", and "under", are defined with respect to the horizontal plane.

Referring now to FIG. 1, therein is shown a left side view of the container sleeve system 100. The container sleeve system 100 is depicted having a sleeve 102 and a container 104. It is contemplated that the container 104 could be a drinking container, a bottle, a canister, or other container type. The sleeve 102 contacts the container 104 and includes a top lip 106.

The top lip 106 can curve around the container 104 ensuring the container 104 is locked into position with more than a friction fit between the sleeve 102 and the container 104. The sleeve 102 can include a top side 108, a bottom side 110, a front side 112, a back side 114, and a left side 116. The sleeve 102 further includes a right side 202 of FIG. 2, which is not shown in the left side view of FIG. 1.

The container 104 can include vertical sides 118, a shoulder 120, and a neck 122. The shoulder 120 of the container 104 can extend and taper between the vertical sides 118 and the neck 122.

The top lip 106 of the sleeve 102 can curve over the vertical sides 118 to contact a portion of the shoulder 120 over halfway between the vertical sides 118 and the neck. The neck 122 is shown exposed and without contacting the sleeve 102. Exposing the neck 122 from the sleeve 102 can provide increased sanitation over prior designs as the sleeve 102 is less likely to contact the user's lips or straws.

The top lip 106 is depicted extending between two-thirds and three-quarters up the shoulder 120 from the vertical sides 118 toward the neck 122. The transition between the vertical sides 118 and the shoulder 120 is shown within cutouts 124, the cutouts 124 being formed into and through the sleeve 102 allowing the container 104 to be seen through the sleeve 102.

The shoulder 120 of the container 104 is depicted beginning within the cutouts 124 near the top side 108 of the sleeve 102, and continues until the neck 122 extends vertically up away from the sleeve 102. The top lip 106, extending between two-thirds and three-quarters up the shoulder 120 from the vertical sides 118 toward the neck 122, has been discovered to provide unexpected benefits over other previous designs by exposing only the top portions of the shoulder 120 producing a properly tensioned fit while exposing functional and aesthetic portions of the container 104.

The cutouts 124 can extend from an external sleeve surface 126 to an internal sleeve surface 128. The internal sleeve surface 128 can be in direct contact with the container 104. The sleeve 102 can further include a sleeve side wall 130 extending from the internal sleeve surface 128 toward the external sleeve surface 126.

The sleeve 102 can further include a chamfered edge 132 between the sleeve side wall 130 and the external sleeve surface 126. The sleeve 102 can be directly coupled to the container 104 at two coupling ends 134, one near the shoulder 120, and the other coupling end 134 near the bottom side 110 of the sleeve 102.

The two coupling ends 134 of the sleeve 102 can be connected with a handle 136 extending therebetween. The handle 136 can extend further away from the container 104 than the external sleeve surface 126 of the coupling ends 134 and provide a gap 138 between the handle 136 and the container 104.

The handle 136 can therefore be fully spaced apart and extend off of the surface of the container 104. The handle 136 can extend away from the container 104 near the coupling ends 134 to an apex at the horizontal centerline of the handle 136. That is, the gap 138 is largest directly under the centerline of the handle 136, which has been discovered to provide many unexpected ergonomic and portability benefits, arising from a proper balance of tension and space between the handle 136 and the container 104. These benefits can include ease of initiating the gripping process and comfort of the grip once attained.

The handle 136 can be formed to extend perpendicularly between the coupling ends 134. The handle 136 can further be coupled to the coupling ends 134 with angled connections 140. The angled connections 140 can provide enhanced structural rigidity to the sleeve 102 and most importantly, the handle 136.

It has been discovered that the angled connections 140 can prevent the handle 136 from tearing or improperly flexing. The sleeve 102 can further include an indent 142. The indent 142 can be positioned within the coupling end 134 near the top lip 106, where the handle 136 meets the coupling end 134. The indent 142 can further extend down, past the coupling end 134, and into the handle 136.

The handle 136 is further depicted including a handle body 144. The handle body 144 can thicken the handle 136 and can be formed on the handle 136 below the indent 142 and extend onto the coupling end 134 having the bottom side 110.

It has been unexpectedly discovered that the disclosed arrangement of the handle 136 and the coupling ends 134 provide increased portability as these features together can form the gap 138 through a friction fit between the coupling ends 134 and the container 104, which can enable users to hold, grip, and carry a reusable drinking container as a one-hand operation. This improvement in portability due to increased user ergonomics can relieve a user's hand fatigue by allowing the user to securely and virtually strap the handle 136 to the user's hand, which reduces the need for the user to always grab, grip, or hold the handle 136, especially on longer journeys.

As will be appreciated by those of ordinary skill in the art, the handle 136 and its described features including the gap 138, the handle body 144, and the angled connections 140 not only increase the portability of the container sleeve system 100 by allowing a user to easily hold the container sleeve system 100 but also increases the durability of the container sleeve system 100 and effectiveness at protecting the container 104 by providing drop protection and drop prevention of the container 104.

The container 104 can further include a lid 146 having a lid handle 148. The lid handle 148 is depicted as pivotally coupled to the lid 146 with a lid handle swivel 150. The lid handle 148 can provide alternate and additional ergonomic advantage to differentiate the container sleeve system 100 in the increasingly competitive container protection market.

As will be appreciated, the sleeve 102 can be formed of material, such as rubber or silicone, that helps protect the container 104 from damage and normal wear and tear by surrounding a large surface area of the container 104 while still allowing the container 104 to be seen and appreciated. The surface area of contact between the sleeve 102 and the container 104 should provide enough friction to stop the sleeve 102 from moving when held by the handle and when the container 104 is full of water.

The container sleeve system 100 has further been discovered to provide protection to containers where previous attempts at protection struggled. Here, the container sleeve system 100 can be formed of silicone or rubber with a thickness of the sleeve side wall 130 thick enough to stretch out and wrap around containers of larger and wider variations.

It is contemplated that the sleeve 102 could be is made in a variety of unique and distinctive colors and shapes. Yet further, it has been discovered that the container sleeve system 100 can be manufactured at substantially lower costs that conventional protective sleeves because the handle 136, the angled connections 140, the handle body 144, and the coupling ends 134 can be manufactured by injection molding as a single piece and in a single molding step.

Figure 2:
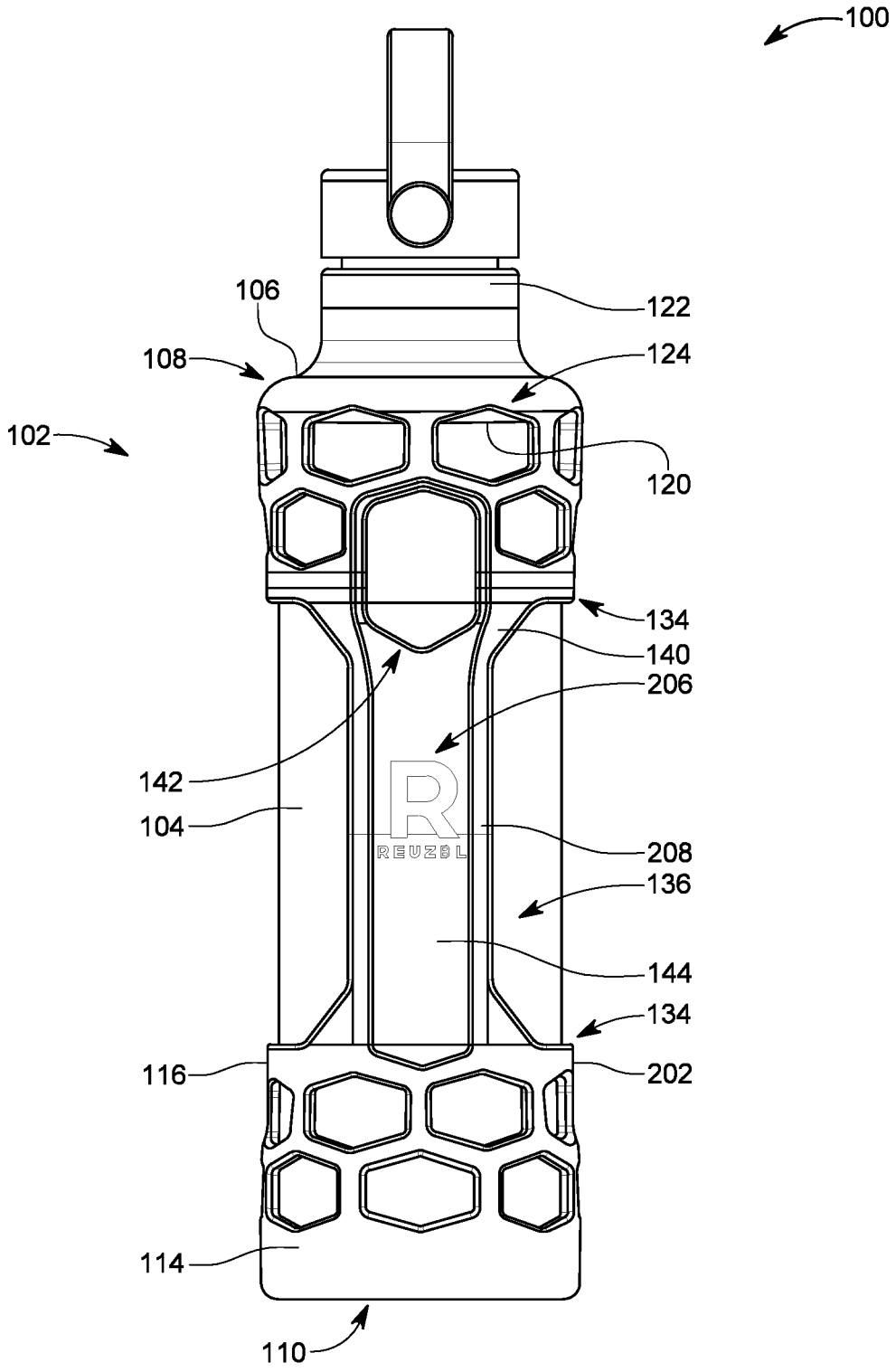
FIG. 2 is a back side view of the container sleeve system of FIG. 1.

Yet still further, it has been discovered that the handle 136—together with the angled connections 140, the handle body 144, and the mark 206 of FIG. 2—can curve out further from the container 104. This can be due to friction created between the container 104 and the sleeve 102 when the container 104 is placed into the sleeve 102.

This curve induced within the handle 136 can increase the gap 138 between the handle 136 and the container 104 creating room for a user to grip the handle 136. It will be appreciated that when there is no container 104, the handle 136 can be straighter.

Thus, the container sleeve system 100 can provide material improvements to durability, portability, and reusability for a variety of reusable drinking containers, with simple and cost effective manufacturing.

Referring now to FIG. 2, therein is shown a back side view of the container sleeve system 100 of FIG. 1. The back side 114 of the container sleeve system 100 is fully depicted including the handle 136.

Along with the top side 108, the bottom side 110, the back side 114, and the left side 116, the sleeve 102 further includes a right side 202. The container 104 is with having the shoulder 120 beginning within the cutouts 124 near the top side 108 of the sleeve 102.

The top lip 106 of the sleeve 102 is depicted as extending onto the shoulder 120 and extending between two-thirds and three-quarters up the shoulder 120. Top portions of the shoulder 120 and the neck 122 of the container 104 are left uncovered by and exposed from the sleeve 102.

The cutouts 124 are shown distributed regularly around the coupling ends 134, with the exception of the indent 142. The indent 142 is shown having the same horizontal width as the cutouts 124 but with more than twice the length as the cutouts 124.

The handle body 144 is depicted extending along a vertical centerline of the handle 136 and down from the handle 136 onto an area of the coupling end 134 near the bottom side 110. The handle 136 is depicted to extend perpendicularly between the coupling ends 134.

The handle 136 can be directly coupled perpendicularly to the coupling ends 134. Additionally the handle 136 can be coupled to the coupling ends 134 with the angled connections 140 extended between the handle 136 and the coupling ends 134.

The handle body 144 can extend up above the angled connections 140 to provide a raised grip, and when coupled with the gap 138 of FIG. 1 provided by handle 136, can provide an unexpectedly improved grip with fewer pinch points. The angled connections 140 further improve cleanliness of the container sleeve system 100 since deep grooves from right angles are avoided. The handle body 144 is shown having a mark 206 formed along a horizontal centerline 208 of the handle 136.

Figure 3:
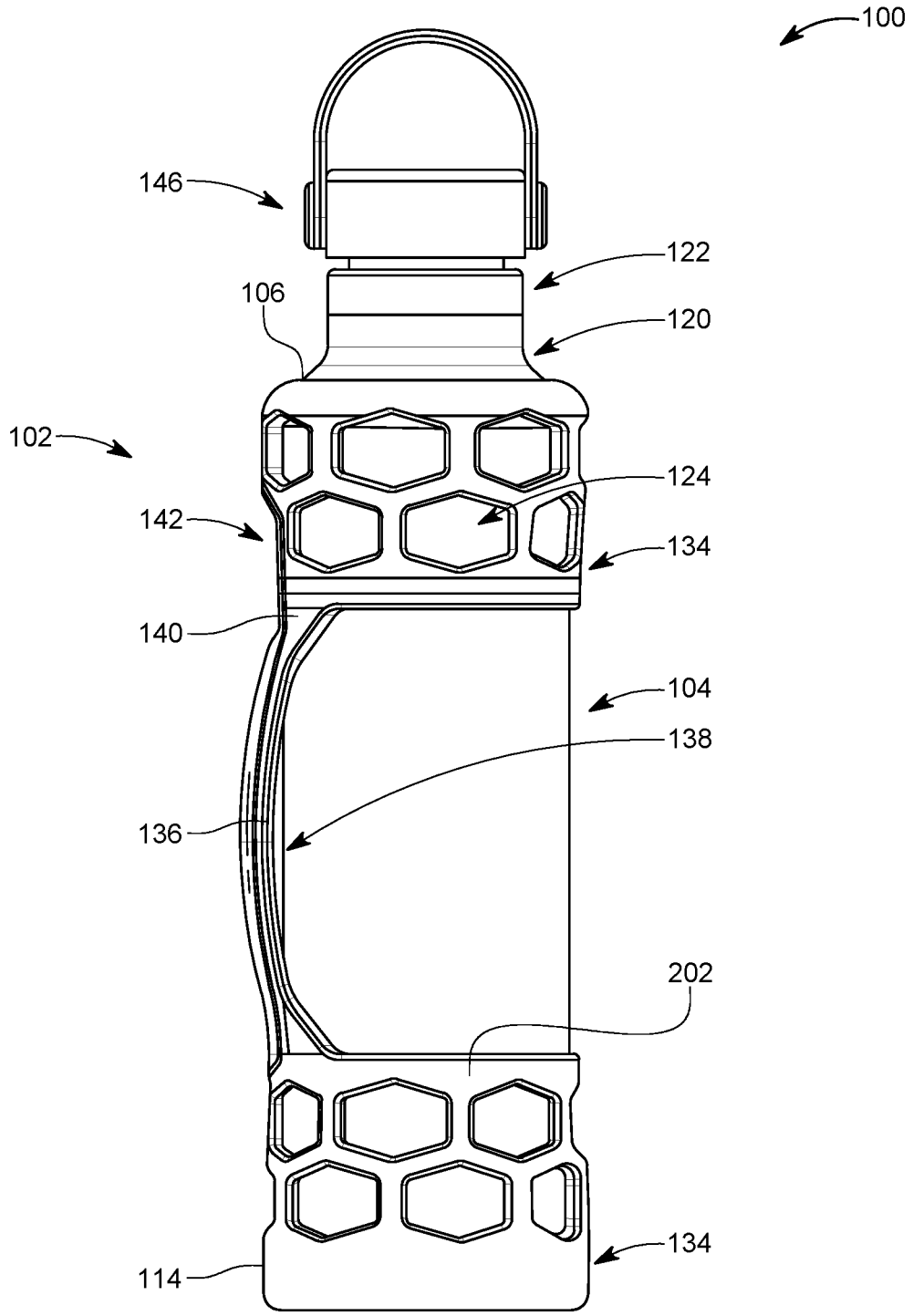
FIG. 3 is a right side view of the container sleeve system of FIG. 1.

Referring now to FIG. 3, therein is shown a right side view of the container sleeve system 100 of FIG. 1. The container sleeve system 100 depicts the right side 202 of the sleeve 102 with the coupling ends 134 connected to one another with the handle 136 near the back side 114.

The coupling ends 134 are depicted having the cutouts 124, which expose portions of the container 104 therefrom. The container 104 is fully exposed from the sleeve 102 between the coupling ends 134 with the exception that the handle 136 contacts the container 104 near the angled connections 140 and the indent 142.

Otherwise, the container 104 is exposed from the sleeve 102 even below the handle 136 where the gap 138 can be seen. The container 104 is depicted extending through the sleeve 102, and out of the sleeve 102 near the top lip 106. A portion of the shoulder 120 is exposed above the top lip 106 together with the neck 122 and the lid 146.

Figure 4:
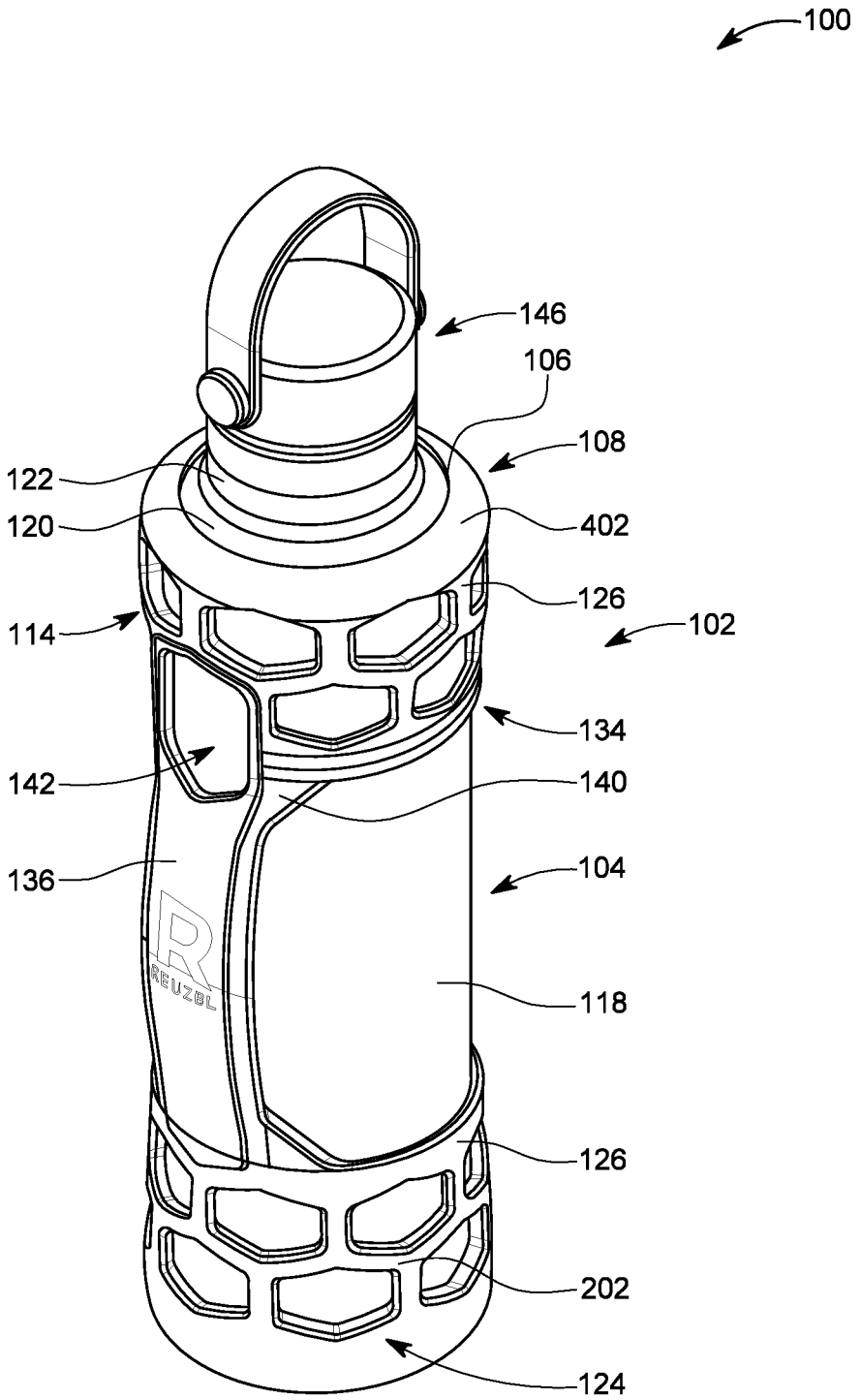
FIG. 4 is an isometric view of the container sleeve system of FIG. 1.

Referring now to FIG. 4, therein is shown an isometric view of the container sleeve system 100 of FIG. 1. The container sleeve system 100 depicts the right side 202 and the top side 108 of the sleeve 102 with the coupling ends 134 connected to one another with the handle 136 near the back side 114.

The coupling ends 134 are depicted having the cutouts 124, which expose portions of the container 104 therefrom. The top side 108 of the sleeve 102 can include a rounded overhang 402.

The rounded overhang 402 can extend from the external sleeve surface 126, over the vertical sides 118 of the container 104 to mechanically lock the container 104 within the sleeve 102. The rounded overhang 402 can terminate in the top lip 106.

The container 104 is fully exposed from the sleeve 102 between the coupling ends 134 with the exception that the handle 136 contacts the container 104 near the angled connections 140 and the indent 142. Otherwise, the container 104 is exposed from the sleeve 102 even below the handle 136 where the gap 138 can be seen. The container 104 is depicted extending through the sleeve 102, and out of the sleeve 102 near the top lip 106. A portion of the shoulder 120 is exposed above the top lip 106 together with the neck 122 and the lid 146.

Figure 5:
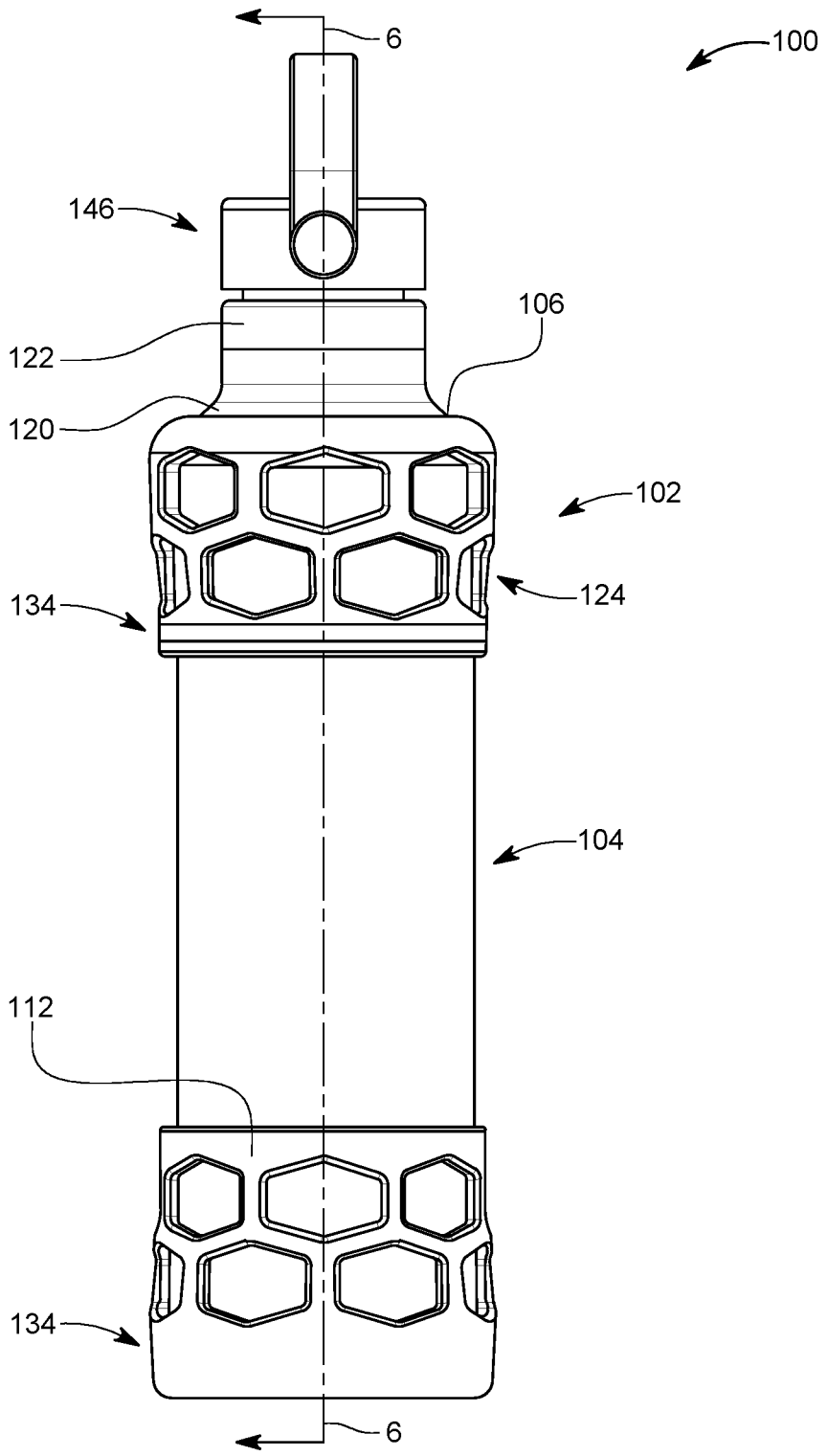
FIG. 5 is a front side view of the container sleeve system of FIG. 1.

Referring now to FIG. 5, therein is shown a front side view of the container sleeve system 100 of FIG. 1. The container sleeve system 100 depicts the front side 112 of the sleeve 102 with the coupling ends 134 physically coupled to the container 104.

The coupling ends 134 are depicted having the cutouts 124, which expose portions of the container 104 therefrom. The container 104 is fully exposed from the sleeve 102 between the coupling ends 134.

The container 104 is depicted extending through the sleeve 102, and out of the sleeve 102 near the top lip 106. A portion of the shoulder 120 is exposed above the top lip 106 together with the neck 122 and the lid 146.

Figure 6:
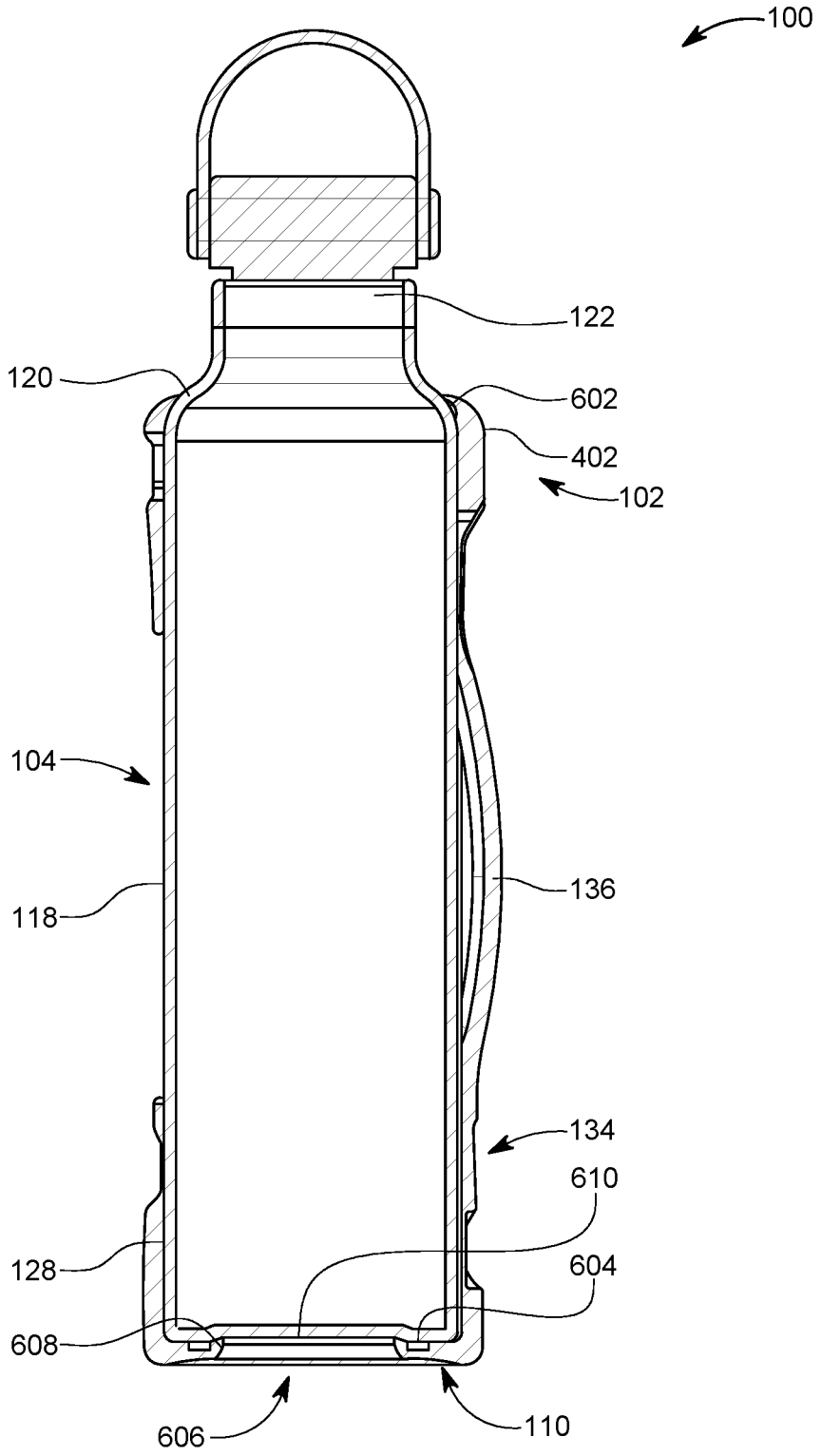
FIG. 6 is a cross-sectional view of the container sleeve system along the line 6-6 of FIG. 5.

Referring now to FIG. 6, therein is shown a cross-sectional view of the container sleeve system 100 along the line 6-6 of FIG. 5. The handle 136 is shown connecting the coupling ends 134.

The internal sleeve surface 128 of the coupling ends 134 is in direct contact with the container 104. The shoulder 120 of the container 104 is shown extending up, at an angle, between the vertical sides 118 and the neck 122.

The rounded overhang 402 in direct contact with the shoulder 120, is shown rounded up and extended over a portion of the shoulder 120. The rounded overhang 402 is shown having top retention recesses 602 formed therein.

The bottom side 110 can also include recesses, such as bottom retention recesses 604. The top retention recesses 602 and the bottom retention recesses 604 can provide reduced slippage between the sleeve 102 and the container 104 by reducing or managing air gaps that can inadvertently form between the sleeve 102 and the container 104.

The top retention recesses 602 and the bottom retention recesses 604 can also allow moisture and dust to collect therein ensuring the contact between the sleeve 102 and the container 104 is clean and dry for a slip free contact.

The bottom side 110 of the sleeve 102 can include a bottom hole 606 and a rounded bottom lip 608. The container 104 can be exposed from the sleeve 102 through the bottom hole 606. The container 104 can include a bottom container recess 610 having a horizontal surface.

The horizontal surface of the bottom container recess 610 can be the same width as the bottom hole 606. The bottom container recess 610 can be a recess into the container 104 with other bottom portions of the container 104 extending down below the bottom container recess 610.

Figure 7:
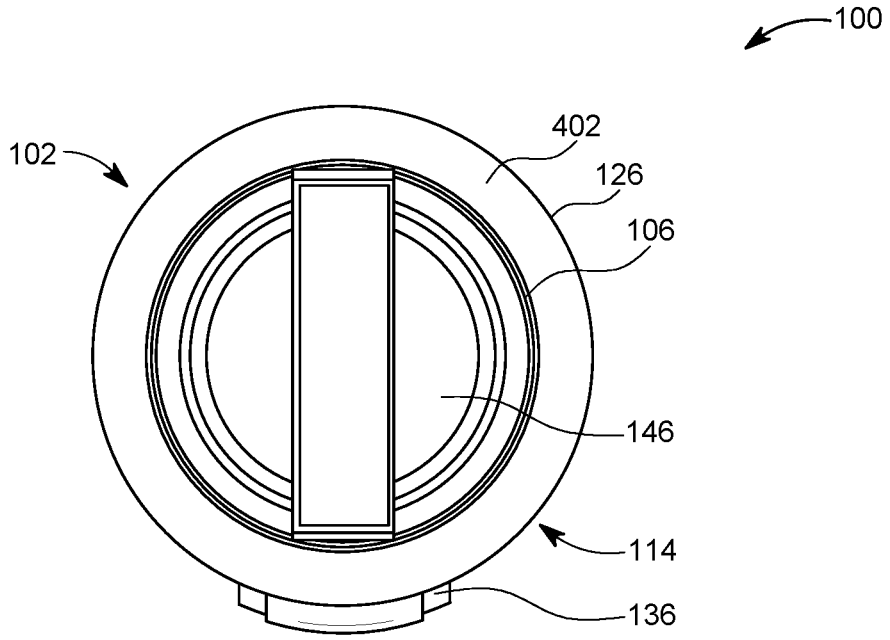
FIG. 7 is a top side view of the container sleeve system of FIG. 1.

Referring now to FIG. 7, therein is shown a top side view of the container sleeve system 100 of FIG. 1. The lid 146 is shown with the rounded overhang 402 extending from the external sleeve surface 126 to the top lip 106. The handle 136 is also shown near a back side 114 of the sleeve 102.

Figure 8:
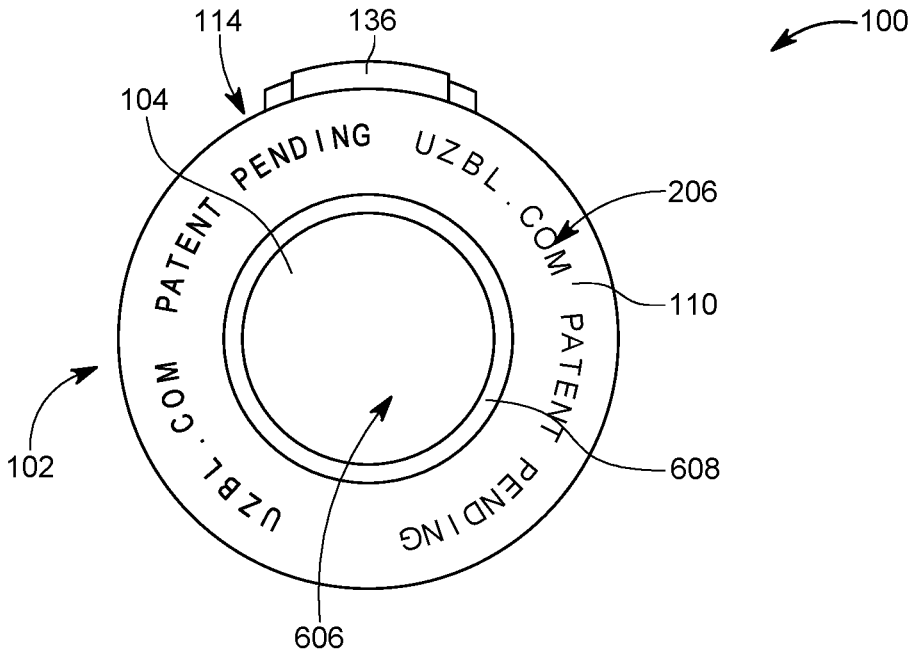
FIG. 8 is a bottom side view of the container sleeve system of FIG. 1.

Referring now to FIG. 8, therein is shown a bottom side view of the container sleeve system 100 of FIG. 1. The sleeve 102 is shown having the bottom hole 606 surrounded by the bottom lip 608 and exposing the container 104 therefrom.

The bottom side 110 is shown having the mark 206. The mark 206 can include surface texturing extending down into the bottom side 110, include pigments at surface or subsurface level, or could include a combination thereof. The handle 136 is also shown near a back side 114 of the sleeve 102.

Figure 9:
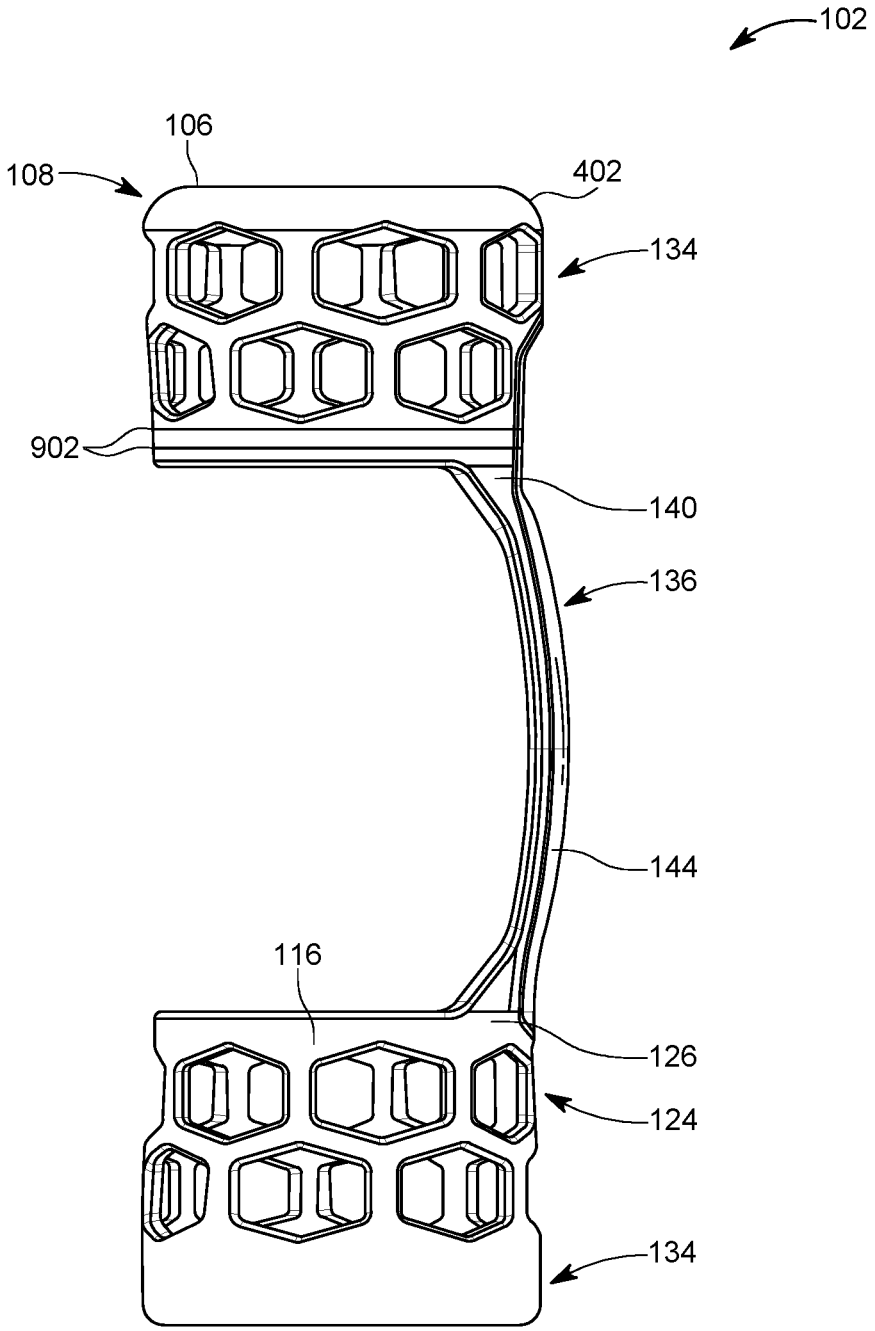
FIG. 9 is a left side view of the sleeve of FIG. 1.

Referring now to FIG. 9, therein is shown a left side view of the sleeve 102 of FIG. 1. The left side 116 of the sleeve 102 can be seen having the cutouts 124 for exposing the container 104 of FIG. 1.

The sleeve 102 can be seen with horizontal grooves 902 on the top coupling end 134. The horizontal grooves 902 can reduce the tendency to slip when gripped. The rounded overhang 402 can extend over the top side 108 and terminate in the top lip 106. The cutouts 124 can extend into the rounded overhang 402.

The handle 136 and the angled connections 140 can be seen coupling the coupling ends 134 together. The handle body 144 is clearly depicted extended away from the external sleeve surface 126 of the bottom coupling end 134 and can be seen extending off of the handle 136.

Figure 10:
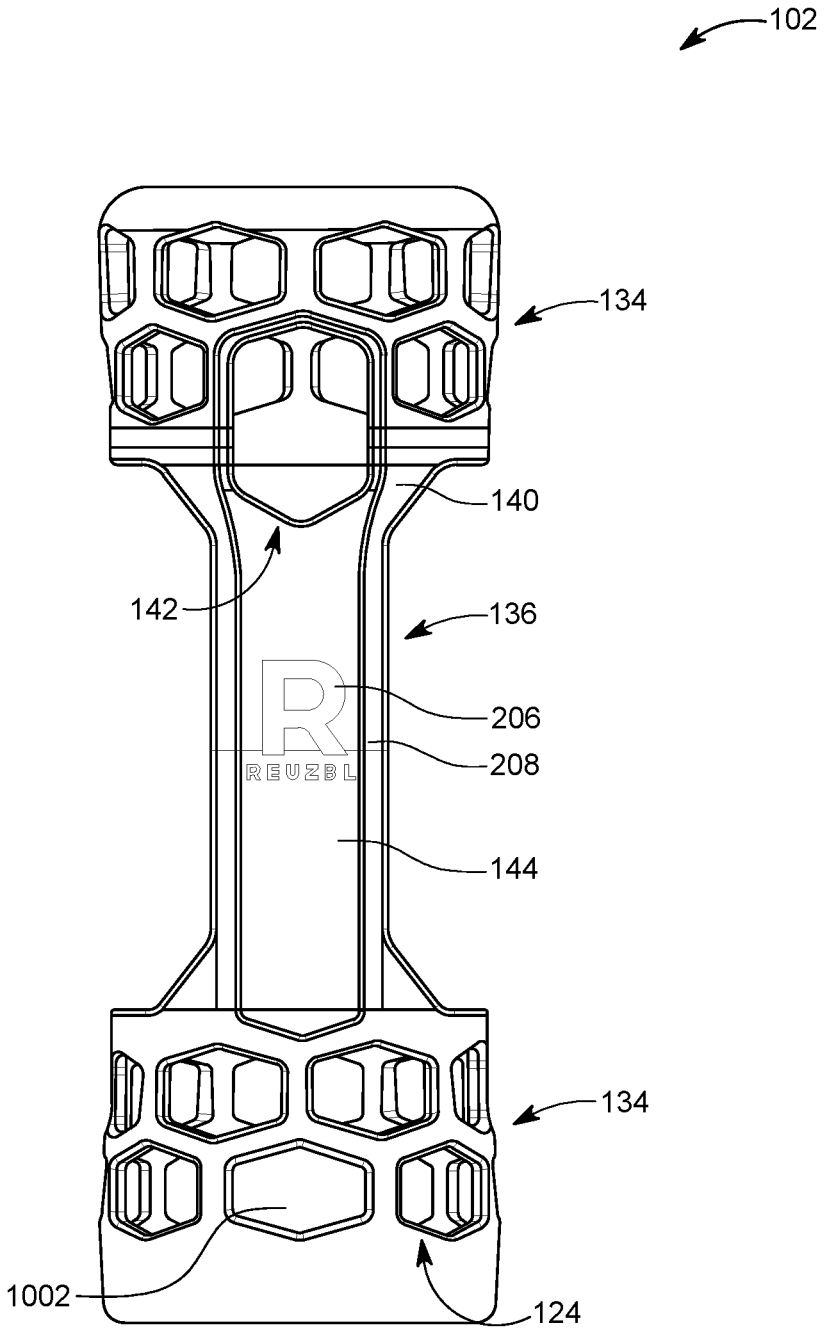
FIG. 10 is a back side view of the sleeve of FIG. 1.

Referring now to FIG. 10, therein is shown a back side view of the sleeve 102 of FIG. 1. The handle 136 is shown connecting the coupling ends 134.

The handle 136 can include the angled connections 140 and the handle body 144 for providing added structural rigidity and portability. The mark 206 can be formed along the horizontal centerline 208. The indent 142 along with the cutouts 124 can be formed completely through the sleeve 102 allowing the opposite side of the sleeve 102 to be viewed therethrough.

The sleeve 102 is further depicted having a recess 1002. The recess 1002 can be a partial cutout, that is the recess 1002 can resemble the cutouts 124 with the difference being that the recess 1002 does not extend fully through the sleeve 102, while the cutouts 124 do.

It has been discovered that the recess 1002 being formed only partially into the sleeve 102 allows the structural stresses of the sleeve 102 to be managed. For example, the recess 1002 is shown positioned directly under a stress line of the handle 136 which stiffens the sleeve 102 more than the cutouts 124 do allowing for an important degree of structural rigidity.

Figure 11:
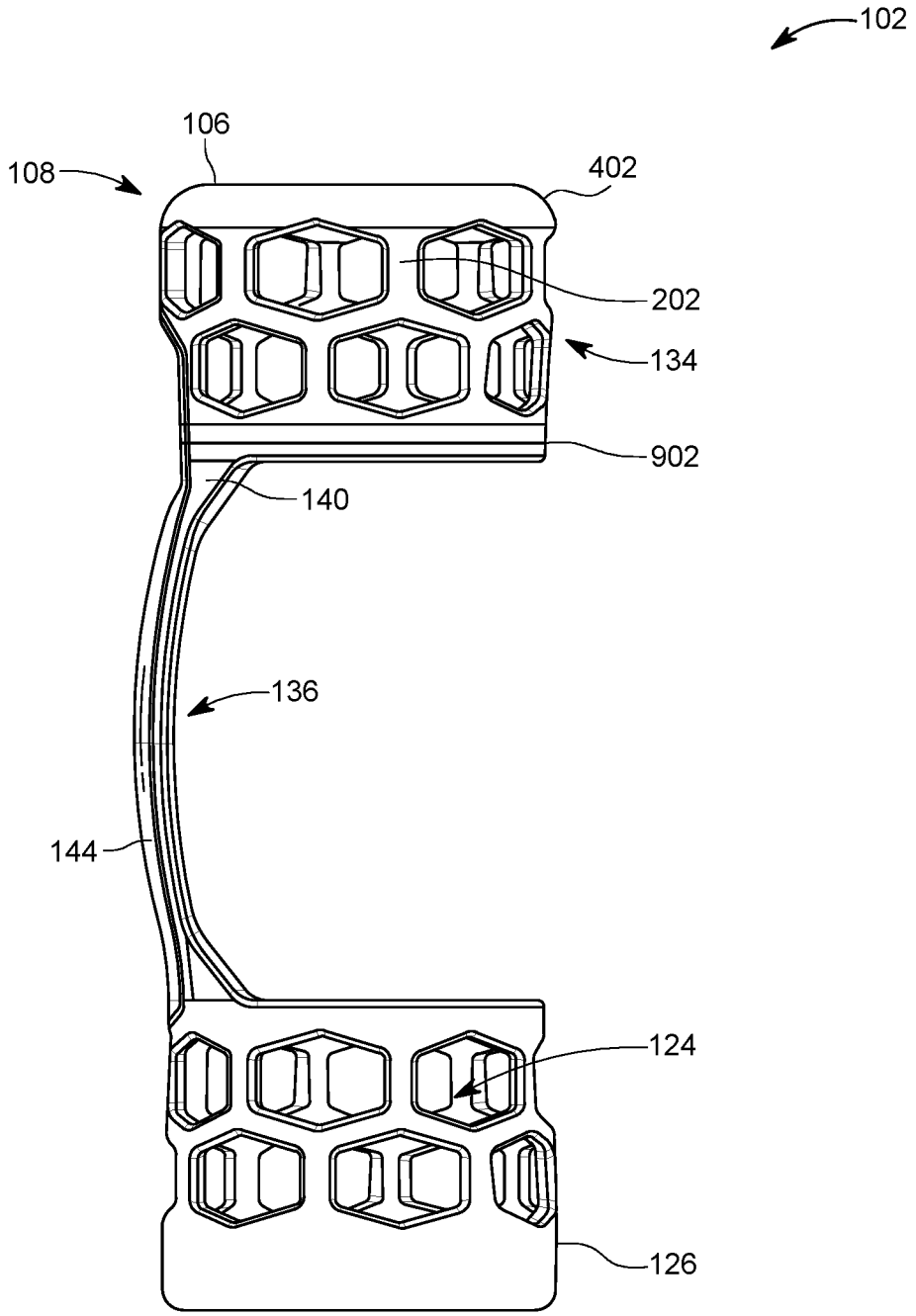
FIG. 11 is a right side view of the sleeve of FIG. 1.

Referring now to FIG. 11, therein is shown a right side view of the sleeve 102 of FIG. 1. The right side 202 of the sleeve 102 can be seen having the cutouts 124 for exposing the container 104 of FIG. 1.

The sleeve 102 can be seen with horizontal grooves 902 on the top coupling end 134. The horizontal grooves 902 can reduce the tendency to slip when gripped. The rounded overhang 402 can extend over the top side 108 and terminate in the top lip 106. The cutouts 124 can extend into the rounded overhang 402.

The handle 136 and the angled connections 140 can be seen coupling the coupling ends 134 together. The handle body 144 is clearly depicted extended away from the external sleeve surface 126 of the bottom coupling end 134 and can be seen extending off of the handle 136.

Figure 12:
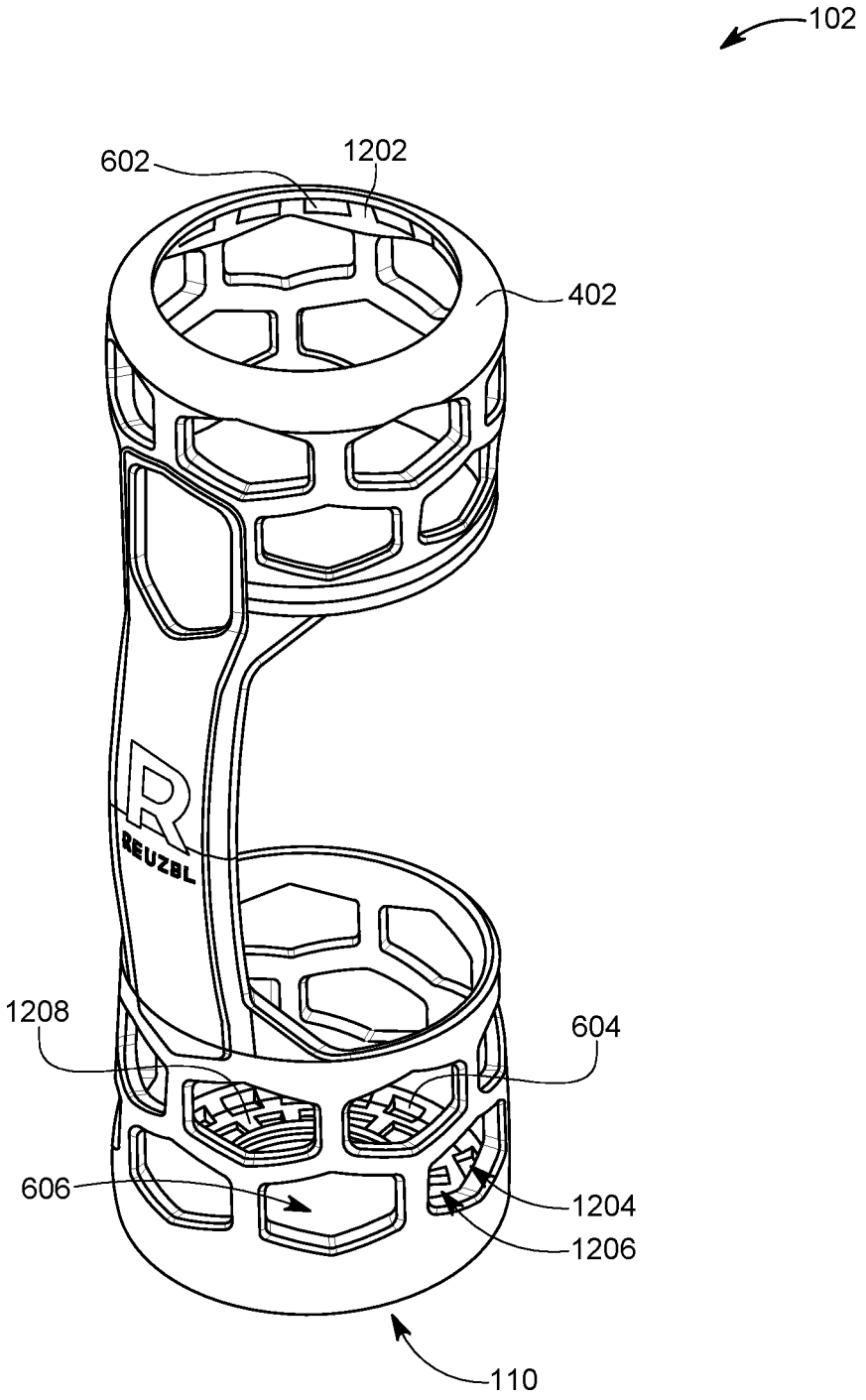
FIG. 12 is an isometric view of the sleeve of FIG. 1.

Referring now to FIG. 12, therein is shown an isometric view of the sleeve 102 of FIG. 1. The sleeve 102 is shown having the top retention recesses 602 in a ring following the rounded overhang 402.

The sleeve 102 can further include top supports 1202 between the top retention recesses 602. The top supports 1202 can extend between the top retention recesses 602 to provide contact with the container 104 of FIG. 1. That is the top supports 1202 can be in direct contact with the container 104 while the top retention recesses 602 can provide an offset from the container 104 for air, moisture, and debris.

The bottom side 110 of the sleeve 102 can include the bottom retention recesses 604 formed within the bottom side 110 without being formed entirely through the bottom side 110. The bottom retention recesses 604 can be arranged in two rings around the bottom hole 606.

That is, the bottom retention recesses 604 can be arranged in an outer ring 1204 and an inner ring 1206 and shown with the bottom support 1208 extending therebetween. The sleeve 102 can further include bottom supports 1208 between the bottom retention recesses 604. The bottom supports 1208 can extend between the bottom retention recesses 604 of both the outer ring 1204 and the inner ring 1206 in order to provide contact with the container 104. The bottom supports 1208 are shown extending between the bottom retention recesses 604 and extending toward a center of the bottom hole 606, the retention recesses 604 being rectangular and arranged around the bottom hole 606. That is the bottom supports 1208 can be in direct contact with the container 104 while the bottom retention recesses 604 can provide an offset from the container 104 for air, moisture, and debris.

That is the external sleeve surface 126 near the top side 108 can angle in closer to the container 104 of FIG. 1 as the coupling end 134 extends away from the top side 108. Conversely, the external sleeve surface 126 near the bottom side 110 can angle in closer to the container 104 as the coupling end 134 extends away from the bottom side 110.

Figure 13:
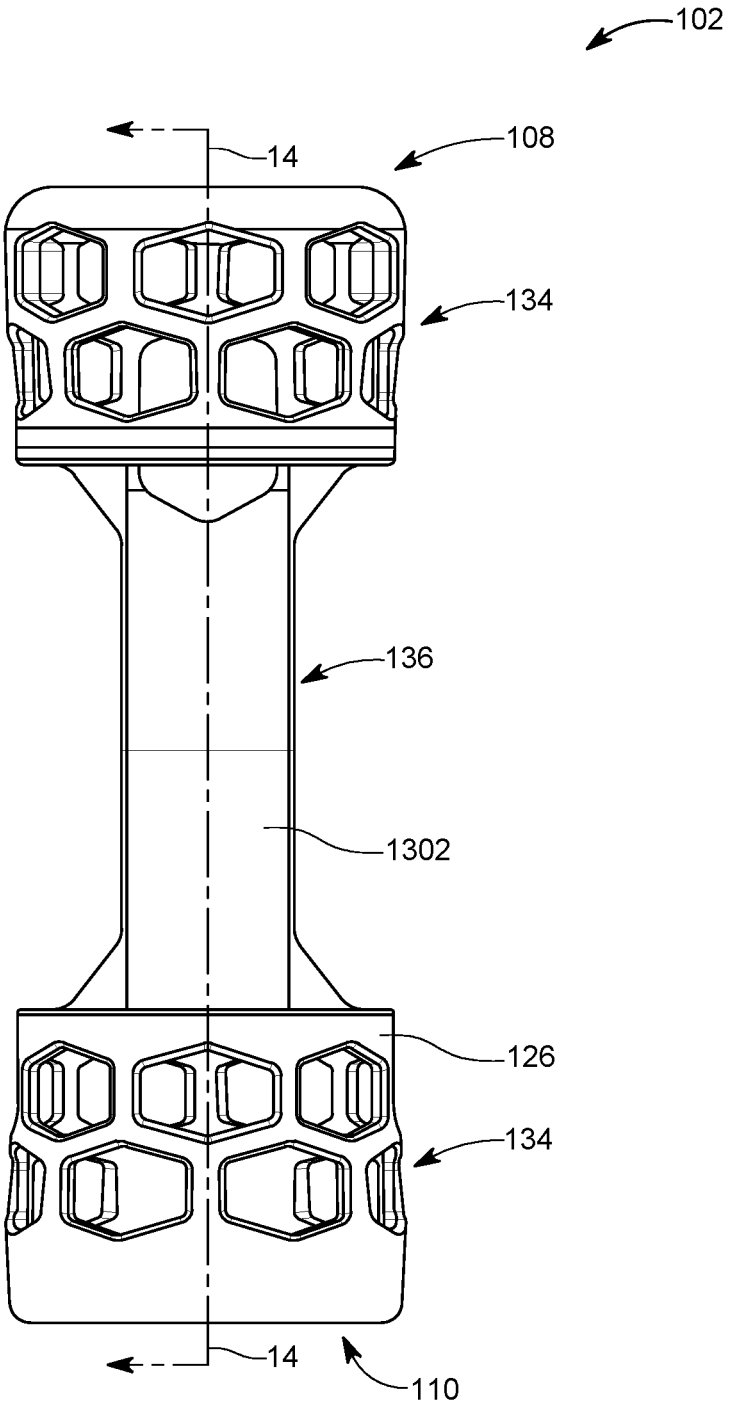
FIG. 13 is a front side view of the sleeve of FIG. 1.
Figure 14:
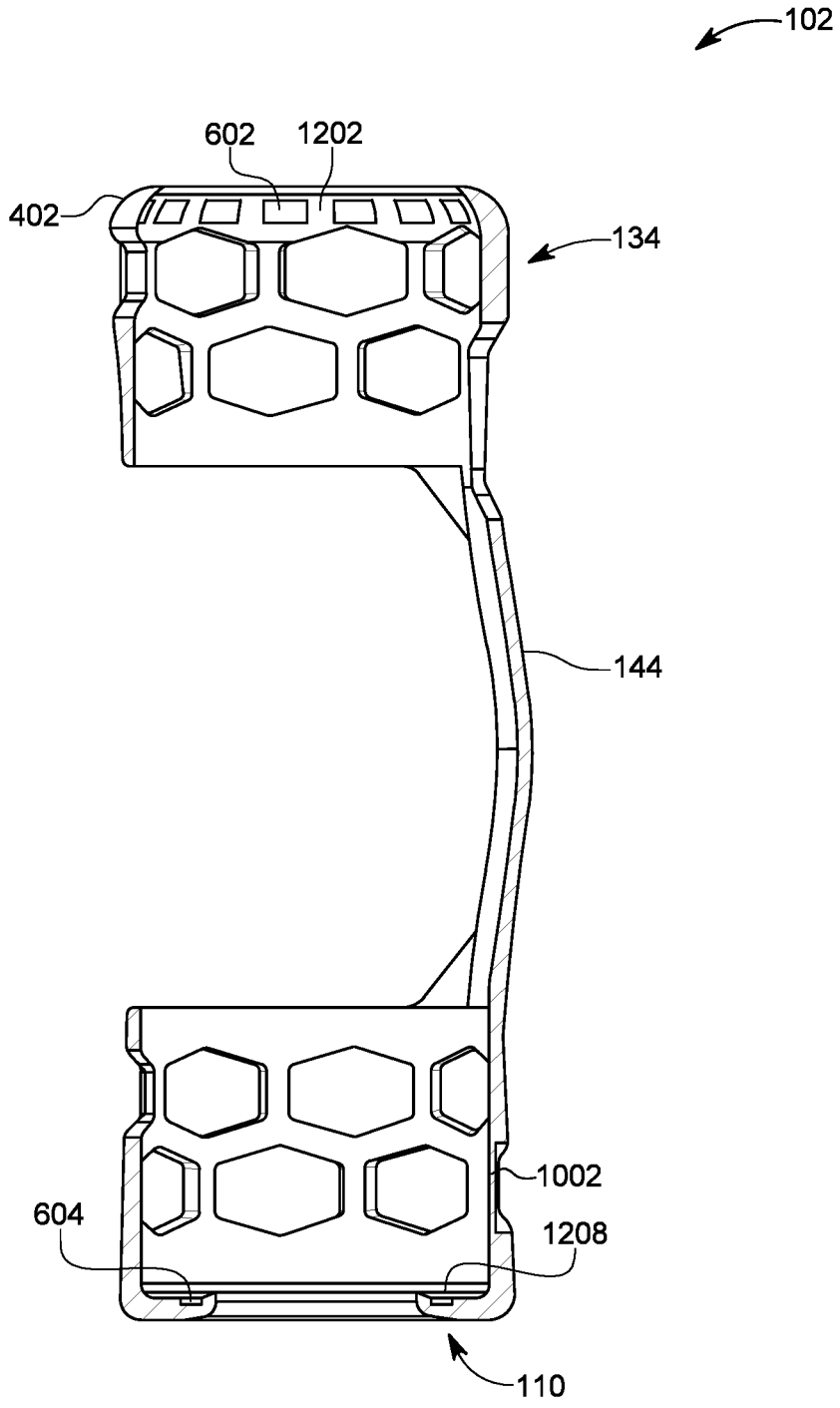
FIG. 14 is a cross-sectional view of the sleeve along the line 14-14 of FIG. 13.

Referring now to FIG. 14, therein is shown a cross-sectional view of the sleeve 102 along the line 14-14 of FIG. 13. The top retention recesses 602 is depicted extended in a ring following the contour and shape of the rounded overhang 402.

The top supports 1202 are depicted as extended between the top retention recesses 602. The bottom retention recesses 604 are also depicted in the coupling end 134 near the bottom side 110. The bottom supports 1208 can extend between the bottom retention recesses 604.

The sleeve 102 is further depicted having the recess 1002 formed partially through the sleeve 102. The recess 1002 is shown to be a partial cutout, that is the recess 1002 can resemble the cutouts 124 with the difference being that the recess 1002 does not extend fully through the sleeve 102, while the cutouts 124 do.

It has been discovered that the recess 1002 being formed only partially into the sleeve 102 allows the structural stresses of the sleeve 102 to be managed. For example, the recess 1002 is shown positioned directly under a stress line of the handle 136 which stiffens the sleeve 102 more than the cutouts 124 do allowing for an important degree of structural rigidity.

Figure 15:
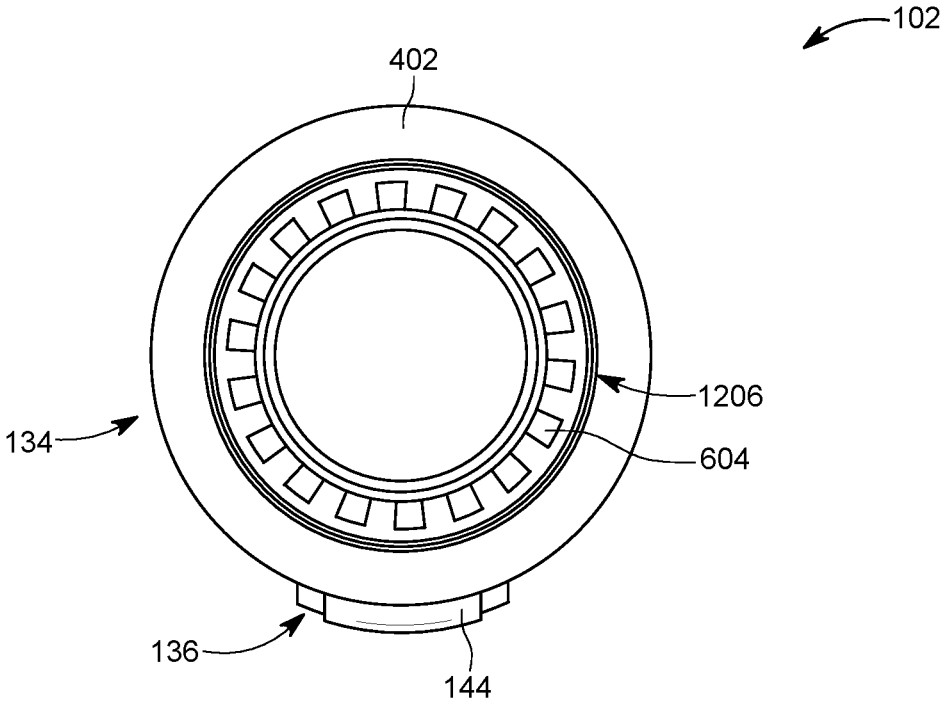
FIG. 15 is a top side view of the sleeve of FIG. 1.

Referring now to FIG. 15, therein is shown a top side view of the sleeve 102 of FIG. 1. The sleeve 102 is illustratively depicted as including the inner ring 1206 of the bottom retention recesses 604 exposed from the rounded overhang 402.

As will be appreciated, the rounded overhang 402 obscures the bottom retention recesses 604 within the outer ring 1204 of FIG. 12. The handle 136 can be seen extended out away from the coupling end 134, with the handle body 144 extending further still.

Figure 16:
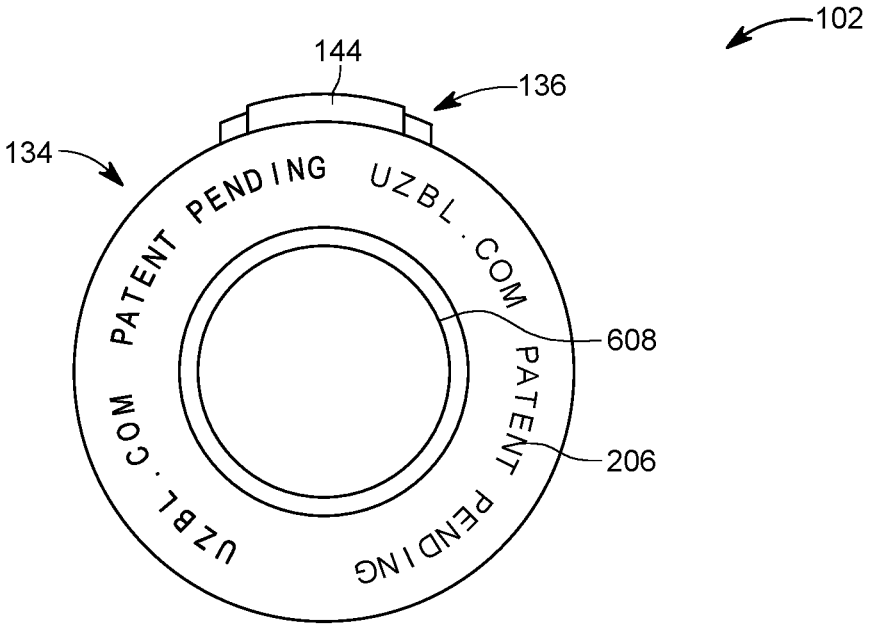
FIG. 16 is a bottom side view of the sleeve of FIG. 1.

Referring now to FIG. 16, therein is shown a bottom side view of the sleeve 102 of FIG. 1. The sleeve 102 can be shown having the mark 206 around the bottom lip 608. The handle 136 can be seen extended out away from the coupling end 134, with the handle body 144 extending further still.

Figure 17:
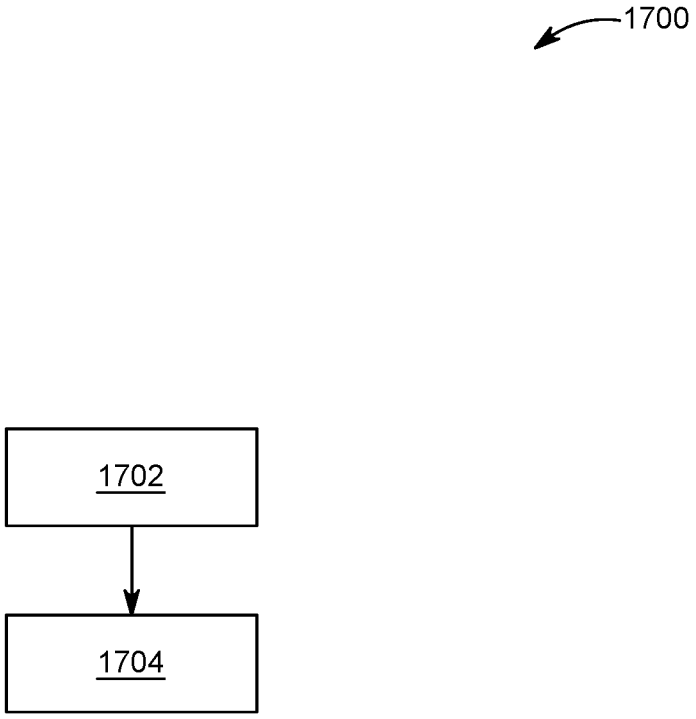
FIG. 17 is a method of manufacturing the container sleeve system of FIG. 1.

Referring now to FIG. 17, therein is shown a method of manufacturing the container sleeve system 100 of FIG. 1. The method of manufacture can include providing a container having a vertical side, a shoulder, a neck, and a lid in a block 1702; and forming a sleeve having coupling ends coupled together with a handle therebetween, the coupling ends including a rounded overhang, the rounded overhang includes top retention recesses formed therein, the coupling ends including bottom retention recesses formed within a bottom side thereof, and the shoulder extending through the rounded overhang, and the handle including a handle body providing thickness to the handle, the handle body formed on the handle and extending onto one of the coupling ends in a block 1704.

Thus, it has been discovered that the container sleeve system furnishes important and heretofore unknown and unavailable solutions, capabilities, and functional aspects. The resulting configurations are straightforward, cost-effective, uncomplicated, highly versatile, accurate, sensitive, and effective, and can be implemented by adapting known components for ready, efficient, and economical manufacturing, application, and utilization.

While the container sleeve system has been described in conjunction with a specific best mode, it is to be understood that many alternatives, modifications, and variations will be apparent to those skilled in the art in light of the preceding description. Accordingly, it is intended to embrace all such alternatives, modifications, and variations, which fall within the scope of the included claims. All matters set forth herein or shown in the accompanying drawings are to be interpreted in an illustrative and non-limiting sense.

What is claimed is:

1. A container sleeve system comprising:

a container having a shoulder; and a sleeve having coupling ends coupled together with a handle therebetween, the coupling ends including a rounded overhang, the coupling ends including bottom supports extending between bottom retention recesses and extending toward a center of a bottom hole, the bottom retention recesses being rectangular and arranged around the bottom hole, and the shoulder extending through the rounded overhang, and the handle including a handle body providing thickness to the handle, the handle body formed on the handle.

2. The container sleeve system of claim 1 wherein: the handle curves away from the container providing a gap therebetween, and the gap due to friction created between the container and the sleeve based on the container being placed into the sleeve.

3. The container sleeve system of claim 1 wherein: the bottom retention recesses are arranged in an outer ring and an inner ring.

4. The container sleeve system of claim 1 further comprising: an angled connection further coupling the handle to one of the coupling ends.

5. The container sleeve system of claim 1 wherein: the sleeve includes an external sleeve surface, a sleeve side wall, and a chamfered edge between the external sleeve surface and the sleeve side wall.

6. A container sleeve system comprising:

a container having a vertical side, a shoulder, a neck, and a lid; and a sleeve having coupling ends coupled together with a handle therebetween, the coupling ends including a rounded overhang, the rounded overhang includes top retention recesses formed therein, the top retention recesses being rectangular and arranged around the rounded overhang, the coupling ends including bottom supports extending between bottom retention recesses and extending toward a center of a bottom hole, the bottom retention recesses being rectangular and arranged around the bottom hole, and the shoulder extending through the rounded overhang, and the handle including a handle body providing thickness to the handle, the handle body formed on the handle and extending onto one of the coupling ends.

7. The container sleeve system of claim 6 further comprising: bottom supports between an inner ring and an outer ring of the bottom retention recesses.

8. The container sleeve system of claim 6 further comprising: a recess extending partially through the sleeve.

9. The container sleeve system of claim 6 wherein: the lid includes a lid handle and a lid handle swivel.

10. The container sleeve system of claim 6 wherein: the sleeve includes a rounded bottom lip exposing the container therefrom.

11. A method of manufacturing a container sleeve system comprising:

providing a container having a shoulder; and forming a sleeve having coupling ends coupled together with a handle therebetween, the coupling ends including a rounded overhang, the coupling ends including bottom supports extending between bottom retention recesses and extending toward a center of a bottom hole, the bottom retention recesses being rectangular and arranged around the bottom hole, and the shoulder extending through the rounded overhang, and the handle including a handle body providing thickness to the handle, the handle body formed on the handle.

12. The method of claim 11 wherein: forming the sleeve includes forming the handle configured to curve away from the container providing a gap therebetween, and the gap due to friction created between the container and the sleeve based on the container being placed into the sleeve.

13. The method of claim 11 wherein: forming the sleeve includes forming the bottom retention recesses arranged in an outer ring and an inner ring.

14. The method of claim 11 wherein: forming the sleeve includes forming an angled connection further coupling the handle to one of the coupling ends.

15. The method of claim 11 wherein: forming the sleeve includes forming an external sleeve surface, a sleeve side wall, and a chamfered edge between the external sleeve surface and the sleeve side wall.

16. The method of claim 11 wherein:

providing the container further includes providing the container having a vertical side, a neck, and a lid; and forming the sleeve includes forming the rounded overhang having top retention recesses formed therein, and forming the handle body extended onto one of the coupling ends.

17. The method of claim 16 wherein: forming the sleeve includes forming bottom supports between an inner row and an outer row of the bottom retention recesses.

18. The method of claim 16 wherein: forming the sleeve includes forming a recess extending partially through the sleeve.

19. The method of claim 16 wherein: providing the container includes providing the lid having a lid handle and a lid handle swivel.

20. The method of claim 16 wherein: forming the sleeve includes forming a rounded bottom lip exposing the container therefrom.

* * * * *